United States Patent [19]

Cartier et al.

[11] 4,345,370

[45] Aug. 24, 1982

[54] METHOD FOR PREPARING THE END OF A FLEXIBLE VERY HIGH FREQUENCY COAXIAL CABLE

[75] Inventors: Jacques Cartier, Fontenay sous Bois; Sebastien Givelet, Paris, both of France

[73] Assignee: Radiall, Rosny-Sous-Bois, France

[21] Appl. No.: 116,827

[22] Filed: Jan. 30, 1980

[30] Foreign Application Priority Data

Jan. 31, 1979 [FR] France ..... 79 02468

[51] Int. Cl.[3] ..... H01B 13/20

[52] U.S. Cl. ..... 29/828; 29/854; 29/860; 140/105; 174/75 C

[58] Field of Search ..... 29/828, 854, 857, 871; 174/93, 75 C, 88 C; 339/177 R, 177 E, 89 C; 140/105, 106, 123

[56] References Cited

U.S. PATENT DOCUMENTS

| | | | |
|---|---|---|---|
| 2,785,385 | 3/1957 | Figueira | 339/177 R X |
| 3,150,231 | 9/1964 | Clark | 174/75 C |
| 3,192,308 | 6/1965 | Van Horssen et al. | 174/75 C X |
| 3,406,373 | 10/1968 | Forney, Jr. | 174/75 C X |
| 3,646,502 | 2/1972 | Hutter et al. | 339/177 E X |
| 4,173,385 | 11/1979 | Fenn et al. | 339/89 C X |

*Primary Examiner*—Francis S. Husar
*Assistant Examiner*—Carl J. Arbes
*Attorney, Agent, or Firm*—Brisebois & Kruger

[57] ABSTRACT

A cable is prepared for mounting a connector, by initially deforming a helically wound strip of the cable to prevent it from unwinding. Then, an outer braided conductor and an outer sheath are cut and stripped from the cable end. Next, a sleeve is inserted beneath the braided conductor, a ferrule is positioned around the cable at the sleeve and the ferrule is clamped to the sleeve. The sleeve can have a flange for mounting the connector in clamped relation on the flange.

10 Claims, 8 Drawing Figures

METHOD FOR PREPARING THE END OF A FLEXIBLE VERY HIGH FREQUENCY COAXIAL CABLE

The present invention relates to a method for preparing the end of a flexible very high frequency coaxial cable to put on or attach a connector element.

More and more, for the transmission of energy at very high frequencies, for example, of the order of 18 GHz, the relatively rigid coaxial elements which are unsatisfactory in numerous applications, particularly aeronautics, are being replaced by flexible coaxial cables.

Such flexible coaxial cables suitable for use at very high frequencies usually consist of a central multistrand conductor, usually of silvered or silver plated copper, and two external conductors, the first a helically wound strip usually of silver plated copper, the second a braided covering also of silver plated copper or the outside of the wound strip.

Between the central conductor and the first external conductor is a dielectric, usually of polytetrafluorethylene (PTFE), ventilated or solid. Finally, around the second external conductor is an external sheath or casing, usually of extruded PTFE, giving both mechanical and chemical protection to the cable. This sheath also keeps the strip forming the first external conductor wound up to the extremities of the cable.

The wound strip forming the first outer conductor permits a continuity which provides for low loss and good efficiency screening. The second external conductor, the braided conductor, reduces the resistance losses at low frequencies when the penetration of the currents (skin effect) is greater than the thickness of the wound strip. In addition, the braided conductor mechanically protects the strip during extrusion of the outside sheath, and severs generally as the mechanical reinforcement of the cable.

Different methods have already been proposed for mounting connector elements on such flexible very high frequency coaxial cables. These different methods, however, present the inconvenience of not always permitting a perfect anchoring or fixing of the connector element on the cable, which is indicated by a decrease in the mechanical integrity, and often a later reduction in the high frequency transmission characteristics at the juncture of the cable to the connector and then a more or less significant unwinding of the strip forming the first external conductor.

The present invention proposes a method to prepare the end of such a flexible very high frequency coaxial cable for attachment of a connector element, which is easy and quick to perform, permits obtaining a connection between the cable and the connector which conserves the high frequency characteristics of the cable, and is resistant to the mechanical strains placed on the cable through the connector.

The method according to the invention is characterized essentially by the fact that first, the end of the cable is crimped at usually two or four places through the external sheathing so as to permanently deform the wound strip. Next, a section of the external sheath is cut and pulled off, and the braided conductor is cut even with the cut end of the sheath to bare a certain length of wound strip. Another section of the external sheath beyond the cut end of the braided conductor is then cut and pulled off so as to bare a certain length of the latter.

A sleeve having an end flange is then introduced under the braided conductor. There is then placed on the outer sheath and the exposed portion of the braided conductor a setting ferrule, and the ferrule is crimped. The sleeve is soldered at its end flange to the wound strip, after which the portion of the strip projecting beyond the flange of the sleeve is unwound and the strip and then the dielectric are cut flush with the flange leaving bare a section of internal conductor.

The end of the cable thus prepared is then placed in a standard connector element. This is done by placing on the bared central conductor at the end of the cable, an insulator in contact with the flange of the sleeve and by then mounting the central contact of the connector on the central conductor and in contact with the insulator. Next, the central contact is joined to the central conductor, and finally the end of the cable furnished with such a connector tip is mounted in the body of the connector, and the assembly is immobilized by screwing a bushing into the rear of the connector body.

Other advantages and characteristics of the invention will become apparent from the following description of one example of implementation of the invention referring to the attached drawings.

BRIEF DESCRIPTION OF THE DRAWINGS

FIG. 5 showing the cable after further stripping of the outside sheath,

FIG. 6 showing the cable with the sleeve and ferrule positioned thereon,

FIG. 7 showing the cable end after stripping the wound strip and inner insulation.

Referring to FIG. 1, one sees a very high frequency coaxial cable including: a central conductor 1 of multistrand silver plated copper wire, for example, 7 or 19 strands; a dielectric 2 such as polytetrafluorethylene (PTFE) foamed or solid, a foam structure being preferred as it allows the high frequency losses to be reduced compared to a solid structure; a first external conductor 3 in the shape of a helically wound silver plated copper strip or ribbon; a second external conductor 4 of braided silver plated copper; and an external protective sheath 5, for example, of extruded PTFE.

The windings of strip 3 overlap by about 50%. These windings are very tight and must be kept very tight to preserve the hyperfrequency characteristics of the cable. Actually, if one winding of the strip makes poor contact with the adjacent winding, this causes discontinuity of the coaxial line which results in an increase in losses and reflection coefficient.

Such flexible very high frequency coaxial cables are presently made, for example by Fileca Company under the reference F 1703/53.

The method according to the invention for preparing the end of such a coaxial cable for the emplacement of a connector element will now be described referring to FIGS. 2 to 7.

With the aid of crimping or stamping pincers whose jaws preferably have in section two opposite internal protuberances, the end of the cable is stamped or crimped through the external sheath 5 of the cable to provide two or preferably four longitudinal indentations 15. This results in permanent deformation of the end of wound strip 3, keeping it from unwinding. This stamping also reduces the external diameter of the wound strip 3, which facilitates mounting the sleeve later, as will be explained below.

Figure 1:
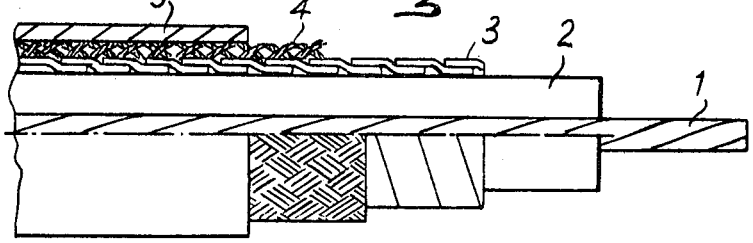
FIG. 1 is a view in partial section of a flexible very high frequency coaxial cable usable for implementing the invention.
Figure 2:
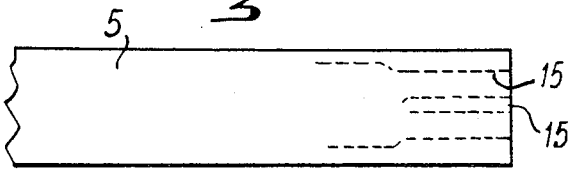
FIGS. 2 to 7 illustrate schematically the implementation of the method according to the invention for preparing the end of the flexible coaxial cable of FIG. 1, FIGS. 2 and 3 showing the configuration of the end of the wound strip after crimping, FIG. 4 showing a cable after cutting and stripping the braided conductor and the outside sheath.
Figure 3:
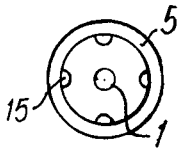

FIG. 3 shows the end of the cable after stamping.

Figure 4:
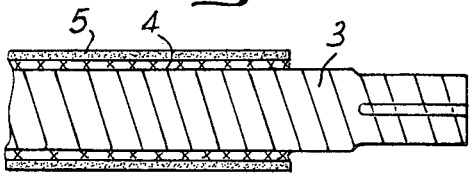
Figure 5:
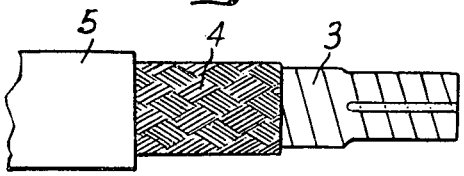

Referring to FIGS. 4 and 5, one sees that a section of sheath 5 beyond the stamped portion of wound strip 3 is cut and stripped and then the braided conductor 4 is cut flush with the sheath. This permits making a straight cut of the braided strip without deforming it, that is, without modifying its braiding pattern. Then another section of the sheath 5 is cut and stripped, baring a section of the braided strip 4 as shown in FIG. 5.

Figure 6:
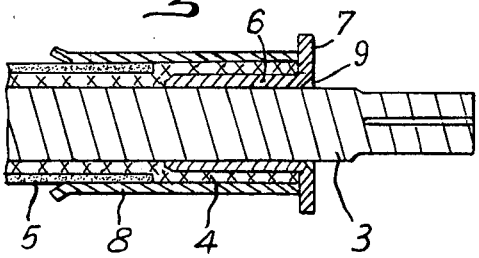

As is shown in FIG. 6, a metallic sleeve 6 with an end flange 7 is then inserted under the portion of braided conductor 4 which has been bared, between conductor 4 and wound strip 3. Care must be taken so that the play between sleeve 6 and strip 3 is as little as possible. Then, from the other end of the cable, an encasing ferrule 8 is forced over the braided conductor and sleeve and into contact with flange 7 of sleeve 6.

As an alternative, ferrule 8 may be slipped on the cable from the same end before the insertion of sleeve 6. Ferrule 8 is crimped, which ensures first that braided conductor 4 will be held tightly between sleeve 6 and the bushing, that is, between two rigid parts, and second, a tight grip on external sheath 5. Such an arrangement provides an effective mechanical fixing of sleeve 6 on the cable and holds wound strip 3 beyond the sleeve flange because of the placement and the fixation of the end of the sheath. The end of sleeve 6 comes nearly to the end of sheath 5 from the right so as to leave no winding of the strip without external mechanical support. Sleeve 6 is then peripherally soldered at its end to strip 3, with solder at the countersunk end 9 of the opening through the sleeve.

This soldering has only an electrical function and does not cause a mechanical immobilization of sleeve 6 on wound strip 3.

Strip 3 is then unwound and cut flush with the exposed end of flange 7 of the sleeve. To do this, one first makes a notch on the strip so that it then tears easily flush with flange 7 of the sleeve.

Figure 7:
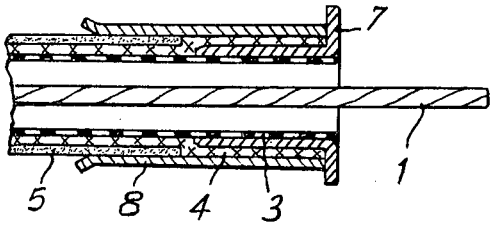

To complete the preparation of the end of the cable, it is then sufficient to cut the dielectric 2 flush with the sleeve flange resulting in the prepared end as shown on FIG. 7 where a section of internal conductor 1 extends beyond flange 7 of the sleeve.

Figure 8:
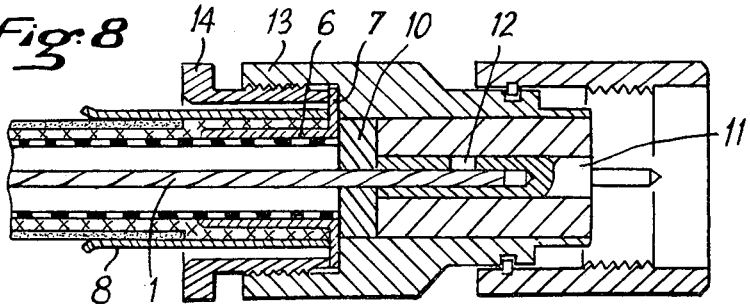
FIG. 8 shows the mounting of the prepared end of the cable in a connector element according to the method of the invention.

FIG. 8 shows the mounting of a cable end thus prepared in a connector element. To achieve this mounting, an insulator disc 10 is placed on bared central conductor 1 of the end of the cable, in contact with the end flange 7. A central contact 11 is then mounted on central conductor 1 in contact with insulator 10 and central contact 11 is soldered to central conductor 1 as indicated at 12.

The coaxial cable, soldered by its central conductor to the central contact, is then placed in a connector body 13 having a shoulder which abuts the end of flange 7 and the body is immobilized by screwing bushing 14 into the body to engage the rear face of flange 7 to fix the connector body to the flange.

Although the invention has been described in connection with one particular embodiment, it is, of course, not limited to such embodiment and various modifications can be made without departing from either the scope or spirit of the invention.

What is claimed is:

1. In a method of preparing the end of a flexible very high frequency coaxial cable to mount a connector element thereon, the cable having a central conductor, a dielectric, a first external conductor in the form of a wound strip, second external conductor in the form of a braided conductor, and an external sheath, the method comprising, as a first step, forming at least two indentations in the wound strip adjacent the end of the cable to prevent the wound strip from unwinding during subsequent operations of mounting the connector element on the cable.

2. The method of claim 1 further comprising, inserting a sleeve between the wound strip and a bared portion of the braided conductor so that an inner end of the sleeve is generally aligned with a cut end of the sheath at the inner end of the bared portion of the braided conductor.

3. Method according to claim 2, further comprising securing said sleeve mechanically to the cable by extending a ferrule over a portion of the sheath and the bared braided conductor, and then crimping the ferrule onto the sleeve.

4. A method according to claim 3 further comprising soldering the sleeve to the wound strip after the sleeve is mechanically secured.

5. A method according to claims 1 or 2 further comprising, removing sections of the external sheath and braided conductor to leave bare a length of the wound strip including the portion with the indentations, and the braided conductor, inserting a sleeve under the braided conductor, placing the ferrule over the sheath and the bare length of the braided conductor, securing the sleeve to the wound strip, and then removing from beyond the sleeve, the wound strip including the portion with the indentations, and dielectric beyond the sleeve to leave a bare section of central conductor.

6. A method according to claim 1 wherein, said step of forming indentations comprises forming circumferentially spaced indentations in the wound strip of a depth sufficient to decrease the external diameter of the wound strip at the end of the cable.

7. In a method of preparing the end of a flexible very high frequency coaxial cable to mount a connector element thereon, the cable having a central conductor, a dielectric, a first external conductor in the form of a wound strip, a second external conductor in the form of a braided conductor, and an external sheath, the method comprising, forming at least two indentations in the wound strip adjacent the end of the cable, and wherein, after the end of the wound strip is deformed, a section of the external sheath is cut and pulled off, the braided conductor is cut flush with the cut end of the sheath to a bare and certain length of wound strip, another section of the external sheath beyond the cut end of the braided conductor is cut and pulled off so as to bare a certain length of the braided conductor, a sleeve with an end flange, is then inserted under the braided conductor, a ferrule is then placed over the sheath and the bared portion of the braided strip, the ferrule is crimped, the sleeve is soldered at its end flange to the wound strip, and then a portion of the wound strip beyond the flange is unwound and the strip and then the dielectric are cut flush with the flange, leaving a bared section of central conductor.

8. The method of claim 1 or 7 wherein the indentations are formed by deforming the wound strip through the external sheath of the cable.

9. The method of claim 1 or 7 wherein the indentations are formed by stamping.

10. The method of claim 7 further comprising, placing an insulator on a bared central conductor of the cable in contact with the sleeve flange, mounting a central contact of a connector on the central conductor and in contact with the insulator, soldering the contact to the central conductor, mounting a connector body on the end of the cable, and fixing the body with a threaded element.

* * * * *